United States Patent [19]

Franklin, Jr. et al.

[11] Patent Number: 4,792,363

[45] Date of Patent: Dec. 20, 1988

[54] VENT CLEANING SYSTEM

[76] Inventors: Smead P. Franklin, Jr., 220 Glenn Dr., Hurst, Tex. 76053; Edgar R. Johnson, 1202 E. French, Temple, Tex. 76501

[21] Appl. No.: 151,017

[22] Filed: Feb. 1, 1988

[51] Int. Cl.[4] ..... A47L 5/38; B08B 1/04

[52] U.S. Cl. ..... 134/8; 15/314; 15/383; 15/395; 134/21

[58] Field of Search ..... 15/387, 383, 395, 314; 134/8, 21

[56] References Cited

U.S. PATENT DOCUMENTS

| | | | |
|---|---|---|---|
| 1,007,888 | 11/1911 | Parker . | |
| 1,538,698 | 5/1925 | Hall | 15/104.1 |
| 1,580,294 | 4/1926 | Gawley | 15/387 X |
| 1,714,287 | 5/1929 | Wilson . | |
| 2,251,739 | 8/1941 | Huntsinger | 15/395 X |
| 2,735,122 | 2/1956 | Pletcher | 15/377 X |
| 4,546,519 | 10/1985 | Pembroke | 15/395 |

FOREIGN PATENT DOCUMENTS

| | | | |
|---|---|---|---|
| 2064410 | 7/1971 | German Democratic Rep. | 15/387 |
| 101152 | 1/1963 | Norway | 15/304 |
| 456984 | 11/1936 | United Kingdom | 15/389 |
| 1062393 | 3/1967 | United Kingdom | 15/314 |
| 1074900 | 7/1967 | United Kingdom | 15/304 |

*Primary Examiner*—Chris K. Moore

*Attorney, Agent, or Firm*—Melvin A. Hunn

[57] ABSTRACT

A vent cleaning system for removing dust from a vent has a brush that substantially occludes the vent, and is rotated by a flexible shaft that is concentrically disposed in a flexible tubular vacuum conduit, so that dust is dislodged from the vent wall and vacuumed into the vacuum conduit.

13 Claims, 2 Drawing Sheets

VENT CLEANING SYSTEM

BACKGROUND OF THE INVENTION

1. Field of the Invention

This invention relates generally to vent and duct cleaning systems, and specifically to a vent cleaning system for removing dust from the air conditioning and heating vents and ducts of residential and commercial buildings.

2. Description of the Prior Art

House dust is widely considered by experts to pose serious health hazards to persons with allergies, asthma, or respiratory disorders and diseases, since it is known to contain dirt, textile fibers, pollen, hair, skin flakes, residue of chemical and household products, decaying organic matter, dust mites, bacteria, fungus, viruses, and a variety of other contaminants. Pounds of house dust accumulate in vents and ducts that comprise the ventilating systems of residential and commercial buildings. This house dust is becoming increasingly more harmful as Americans spend a larger percentage of their waking hours indoors.

Air filters are often placed at the intake of ventilating systems; however, such filters are often inadequate in removing the majority of the dust from the air. Filters may trap as little as twenty percent of the house dust circulating in a ventilating system, allowing the remaining dust to circulate in the household or work place.

Outbreaks of diseases have been linked to improperly maintained ventilating systems, including the outbreak of Legionaire's disease in 1976.

The current state of the art in cleaning ventilating systems comprises a two step process. First, the ventilating system is manually cleaned as far back as can be reached without taking the vent apart. In most ventilating systems, the vent can only be manually cleaned for a distance of about 12 inches from the opening. This is true, because most ventilating systems have vents that make sharp 90 degree turns very close to the vent openings.

Second, the remainder of the ventilating system is treated by coating it with a layer of water-based resin, known in the trade as "soot sealer". This compound is commonly used in fire restoration of ventilating systems.

In practice, a gauze is taped over all ventilating system openings, and a hole is cut in the plenum of the ventilating system. An electric misting fogger is mounted over and coupled to the hole. The fogger is activated and the soot sealer is dispersed throughout the ventilating system. The soot sealer forms a coating over of the inner walls of the entire vent system, encapsulating dust and other harmful impurities.

The dust is not removed from the system, rather the sealant actually forms a new interior vent surface and the dust is trapped between the vent wall and the sealant surface.

This current method has several inherent limitations. First, since the soot sealer is a water based resin, it is susceptible to dissolution if exposed to water or high humidity. Upon dissolution, the previously trapped dust is freed to circulate once again. Second, this process is relatively expensive due to the consumption of soot sealer, and the laborintensive nature of properly cleaning all vent openings, sealing all vent openings, and cutting a hole in the ventilating system plenum.

SUMMARY OF THE INVENTION

The present invention is system for removing dust from a vent, or plurality of vents, that comprise a ventilating system. In the preferred embodiment, the apparatus comprises the combination of a flexible tubular conduit having an intake opening at one end and an exhaust opening at the opposite end, a flexible rotatable shaft concentrically disposed within said flexible tubular conduit and substantially extending between said intake opening and said exhaust opening, a soft bristled brush coupled to said flexible rotatable shaft at the intake opening of said flexible tubular conduit, a shaft motor means for rotating said flexible rotatable shaft, and a vacuum means for entraining dust dislodged by the action of the brush.

As a method, the present invention comprises a combination of inserting a brush that is coupled to a flexible rotatable shaft disposed within a flexible vacuum conduit into a vent, rotating the flexible rotatable shaft to cause the brush to rotate in the vent and dislodge dust, and applying a vacuum source to the vacuum conduit to draw an air stream containing the dust from the vent into the conduit.

The above as well as additional objects, features, and advantages of the invention will become apparent in the following detailed description.

DESCRIPTION OF THE PREFERRED EMBODIMENT

Figure 1:
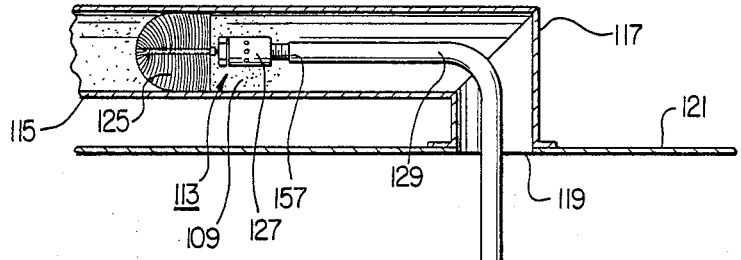
FIG. 1 is perspective view of the apparatus in accordance with the present invention shown in partial cutaway view, having a brush assembly disposed in a vent shown in cross-section.

In FIG. 1, the vent cleaning apparatus 111 is shown in partial cut-away view. Brush assembly 113 of vent cleaning apparatus 111 is shown disposed in vent 115. Vent 115 is shown in cross-section. For purposes of this application, the term "vent" is considered to comprehend all types of ventilating system conduits, including vents, and ducts.

Vent 115 runs parallel to ceiling 121, then forms a right angle 117 with the ceiling 121, and terminates at vent opening 119. This is a very common configuration for vents.

Brush assembly 113 comprises brush 125, collar 127, and flexible tubular conduit 129. In the preferred embodiment, flexible tubular conduit 129 is a 25 feet long, 1½ inch diameter flexible plastic hose, having an intake opening 157 (not shown) in close physical proximity to brush 125, and an exhaust opening 159 (not shown) at the opposite end. Collar 127 is carried in intake opening 157, and is adapted to rotatably carry brush shaft 313 of FIG. 3.

In the preferred embodiment, female connector 147 is secured to the exhaust opening 159 of flexible tubular conduit 129, and serves to releasably mate the flexible tubular conduit 129 with leg 207 of sanitary-tee 131. Sanitary-tee 131 is a y-shaped connector formed of 1½ inch diameter polyvinylchloride tubing, having a head 205, and two legs 207, 209 spaced apart at a forty-five degree angle.

Head 205 of sanitary-tee 131 mates with housing 143 of vent cleaning apparatus 111. Housing 143 is a rectangular fiberglass housing, having a hinged door 149 disposed along its top region allowing access to the interior of said housing 143. Housing 143 is supported by four casters 145, allowing the vent cleaning apparatus 111 to be moved with ease.

A shaft motor 141 is disposed rearward of the sanitary-tee 131, in the interior of housing 143. In the preferred embodiment, shaft motor 141 comprises a ½ horsepower electric drill motor with variable speed control; it is releasably coupled to a flexible shaft 219 of FIG. 2.

A vacuum hose 133 is connected to leg 209 of sanitary-tee 131 by female vacuum hose connector 151. In the preferred embodiment, vacuum hose 133 is a ten feet long, 1½ inch diameter flexible hose. The opposite end of vacuum hose 133 mates with vacuum intake 153 which is disposed along one side of housing 143.

Vacuum intake 153 leads to the interior of housing 143; specifically, to filter 135, which is disposed above and coupled to a vacuum motor 137. In the preferred embodiment, vacuum motor 137 is a Lamb 1¼ horsepower electric motor, of the type commonly found in vacuum cleaning equipment. Bag feed conduit 155 leads from vacuum motor 137 to vacuum bag 139.

Figure 2:
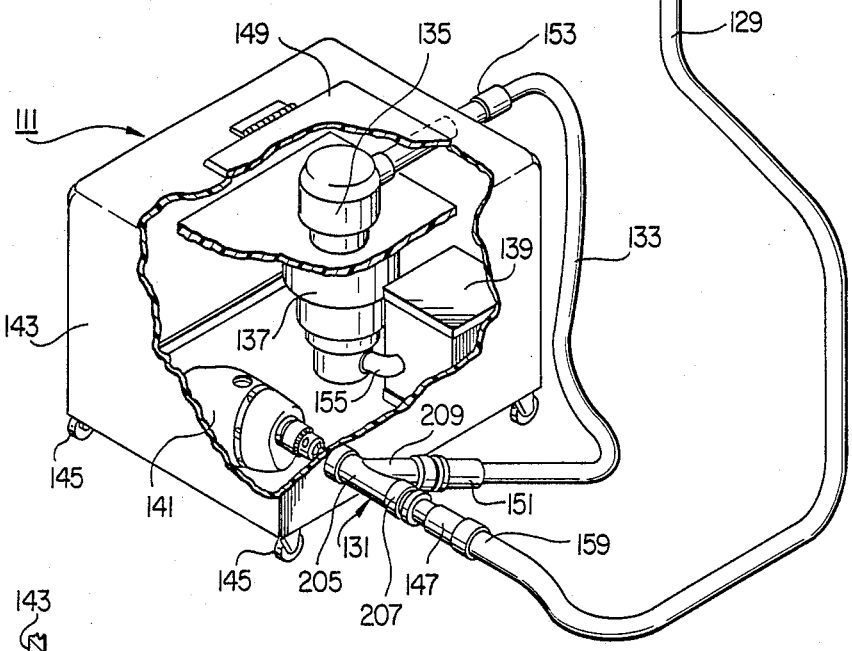
FIG. 2 is a cross-section view of the sanitary-T of FIG. 1.
Figure 2:
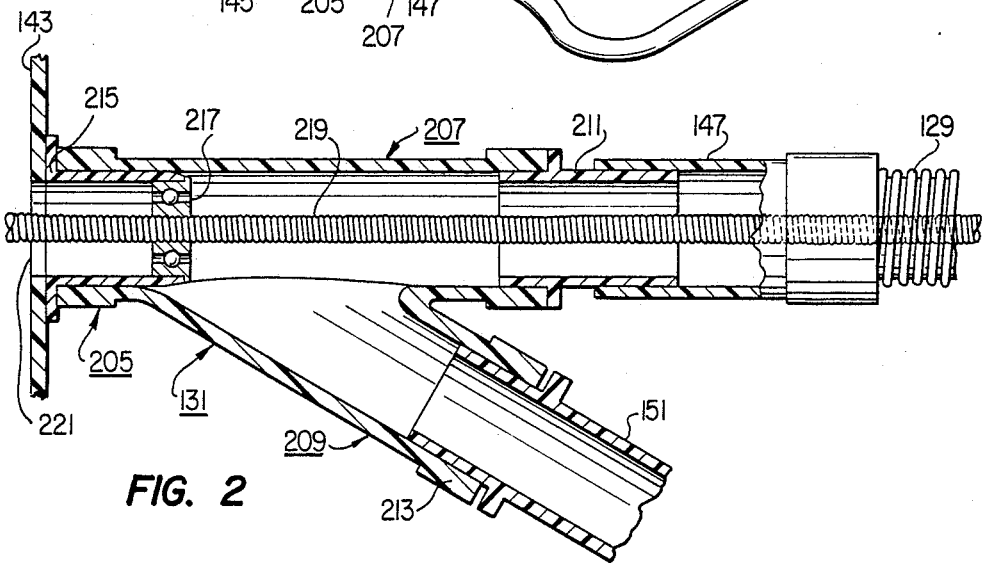

FIG. 2 is a cross-section view of the sanitary-tee of FIG. 1. As in FIG. 1, the sanitary-tee 131 is disposed between housing wall 143 and flexible tubular conduit 129. Male connector 211 is disposed in the opening of leg 207, and is adapted to mate with female connector 147 of flexible tubular conduit 129.

Female connector 213 is formed in the opening of leg 209 of sanitary-tee 131, and is adapted to mate with vacuum hose 133 at male vacuum hose connector 151.

The head 205 of sanitary-tee 131 is adapted to mate with male housing connector 215. Bearing 217 is carried by male housing connector 215. In the preferred embodiment, bearing 217 is a 1½ inch diameter bearing having a ⅜ inch diameter bore for receiving a flexible shaft 219, which in the preferred embodiment is a ⅜ inch diameter flexible shaft of the type used by plumbers, and referred to in that trade as a "snake".

Flexible shaft 219 is releasably coupled to flexible shaft motor 141 and exits housing 143 at shaft opening 221. Flexible shaft 219 enters head 205 of sanitary-tee 131, passes through bearing 217, extends along leg 207 of sanitary-tee, and enters flexible tubular conduit 129, where it is substantially concentrically disposed. In the preferred embodiment, flexible shaft 219 is a twenty-five foot flexible shaft that extends the entire length of flexible tubular conduit 129 to the collar 127 of brush assembly 113 in FIG. 1.

Flexible shaft has a diameter substantially smaller than the diameter of the flexible tubular conduit 129, so airflow in the flexible tubular conduit is not obstructed. Flexible shaft 219 also serves to provide some rigidity to tubular conduit 129.

Figure 3:
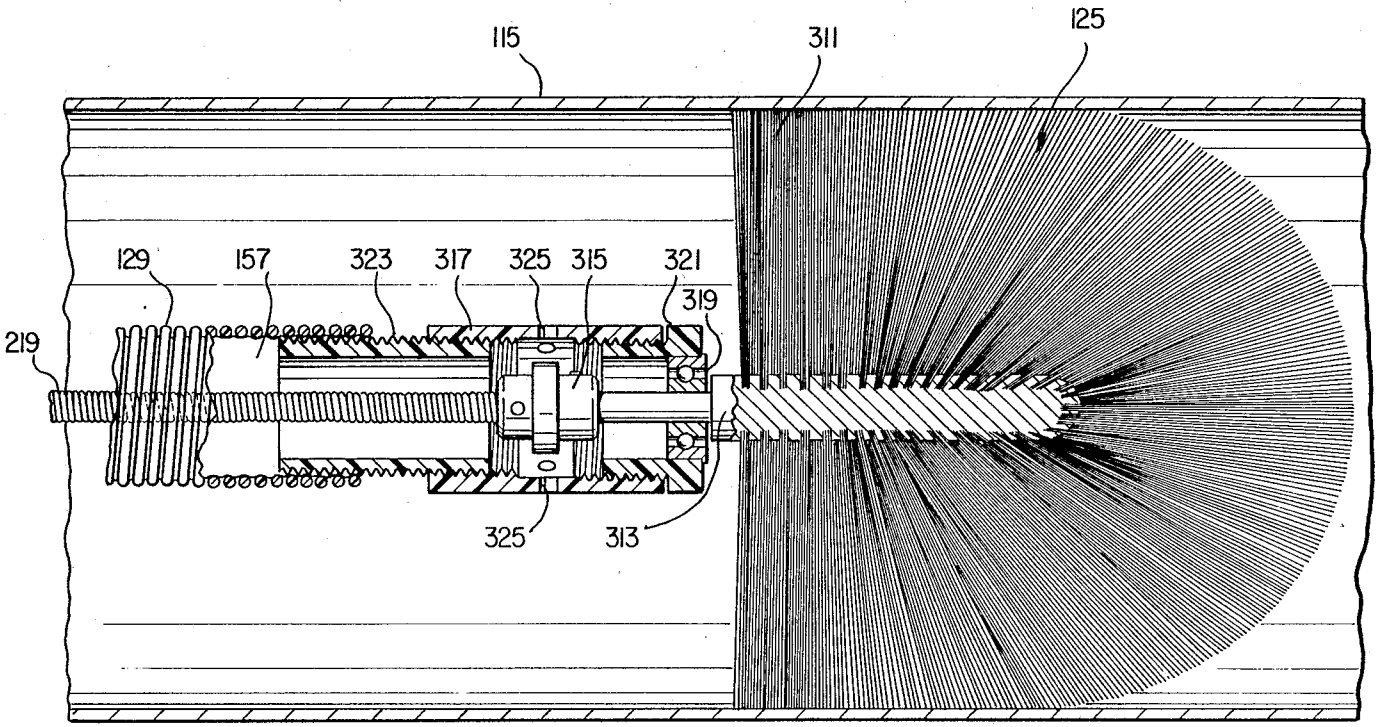
FIG. 3 is a cross-section view of the brush assembly of FIG. 1.

FIG. 3 is a cross-section of brush assembly 113 disposed in vent 115. Brush 125 has a plurality of flexible bristles 311 carried on a brush shaft 313. Brush 125 is adapted in size to substantially occlude vent 115. Brush shaft 313 is coupled to flexible shaft 219 by coupling 315 which is disposed in collar 317, which in the preferred embodiment is a 1½ inch diameter polyvinylchloride pipe collar.

Brush shaft 313 is carried in collar 317 by bearing 319, which in the preferred embodiment, is a 1½ inch diameter bearing having a ⅜ inch diameter hole for receiving brush shaft 313. Bearing 319 is carried in a bearing assembly 321 which is adapted to threadingly engage with collar 317. A threaded conduit connector 323 fits in the intake opening 157 of flexible tubular conduit 129 and is adapted to threadingly engage collar 317. A plurality of intake ports 325 are provided in collar 317. These intake ports 325 allow air to flow between the interior space of vent 115 and the intake opening of flexible tubular conduit 129.

In operation, the vent cleaning apparatus 111 is used to remove dust 109 from vent 115. The brush assembly 113 is inserted in vent 115. Since both flexible tubular conduit 129 and flexible shaft 219 will bend, the brush assembly 113 may be inserted in vents that have various angles that would prevent ordinary cleaning.

After the brush assembly 113 is inserted as far as desired, the flexible shaft motor 141 is engaged, causing flexible shaft 219 of FIG. 2 to rotate within flexible tubular conduit 129. Bearings 217 of FIG. 2 and 319 of FIG. 3 cooperate to allow flexible shaft 219 and coupled brush shaft 313 to rotate at a high frequency.

Brush 125 will act to dislodged dust 109 from the vent 115 walls. Vacuum motor 137 is engaged to pull a vacuum through vacuum hose 133, sanitary-tee 131, and flexible tubular conduit 129. Since brush 125 substantially occludes vent 115, a good vacuum can be drawn by vacuum motor 137.

An air stream containing the dislodged dust 109 is pulled through intake ports 325 of FIG. 3 into the intake opening 157 of flexible tubular conduit 129. From there, the air stream containing the dust 109 is pulled toward the sanitary-tee 131, where it is diverted into second leg 209, and vacuum hose 133. Next, the air stream is pulled through filter 135 of FIG. 1, and directed to vacuum bag 139 via bag feed conduit 155. The dust 109 is removed from the air stream at filter 135 and vacuum bag 139, and the clean air stream is allowed to vent to the environment.

As a method, the vent cleaning system can be described as a combination of the steps of first providing a brush coupled to a flexible rotatable shaft that is disposed within a flexible vacuum conduit. Second, inserting the brush into a selected vent to substantially occluding said vent. Third, rotating said flexible rotatable shaft to cause said brush to rotate in the vent and dislodge the dust. Fourth, applying a vacuum source to the vacuum conduit to draw an air stream containing said dust from the vent and into the conduit. Fifth, removing the brush from the vent while rotating the brush and vacuuming the dust. The means for rotating the brush and for vacuuming the dust should be independently controllable so that the operator can either dust, or vacuum, or both dust and vacuum simultaneously.

This invention has several distinct advantages over the prior art system. First, the dust is actually removed from the vent, rather than coated over with a chemical sealant. Second, the present vent cleaning system is much more economical than the use of soot sealers to entomb the dust within the vent. This is true because no products are consumed in this cleaning process, with the exception of the electricity used to run the apparatus. Third, the present invention is a much simpler approach to cleaning a vent system, since it does not entail the covering of all vent openings and the introduction of a sealant through a hole especially cut to render the ventilating system accessible.

While the invention has been described in only one of its forms, it should be apparent to those skilled in the art that it is not so limited, but is susceptible to various changes and modifications without departing from the spirit thereof.

We claim:

1. An apparatus for removing dust from a vent of the type forming an angle with a vent opening and having a vent diameter, comprising:

a flexible tubular conduit having a conduit diameter substantially less than said vent diameter for allowing said tubular conduit to be passed through said angle in said vent and an intake opening at one end and an exhaust opening at the opposite end;

a flexible shaft located within said flexible tubular conduit and extending substantially between said intake opening and said exhaust opening;

a brush coupled to said flexible shaft at approximately said intake opening of said flexible tubular conduit, said brush having a plurality of flexible bristles located externally of said flexible tubular conduit, and having a brush diameter substantially greater than said conduit diameter of said flexible tubular conduit, wherein said brush is adapted in diameter to substantially occlude said vent substantially obstructing the flow of air therethrough;

motor means, coupled to said flexible shaft at approximately said exhaust opening of said flexible tubular conduit, for rotating said flexible shaft causing said brush to dislodge said dust from said vent; and vacuum means for entraining said dust dislodged by said brush and drawing said dust from said intake opening of said flexible tubular conduit to said exhaust opening of said flexible tubular conduit.

2. An apparatus according to claim 1, wherein said brush bristles are located externally of said flexible tubular conduit on a brush shaft, the brush shaft being coupled to the flexible shaft.

3. An apparatus according to claim 1 wherein said flexible rotatable shaft is concentrically disposed within said flexible tubular conduit and has a diameter substantially smaller than the diameter of said flexible tubular conduit for allowing unobstructed air flow in said flexible conduit.

4. An apparatus according to claim 1 wherein said flexible rotatable shaft provides rigidity to said flexible tubular conduit.

5. An apparatus according to claim 1 wherein the speed of rotation of said shaft motor means is controllable independently of said vacuum means.

6. An apparatus according to claim 1 wherein said flexible bristles of said brush are radially disposed about said brush shaft.

7. An apparatus according to claim 1 further comprising:

a filter means coupled to said exhaust opening of said flexible tubular conduit for capturing said dust.

8. An apparatus according to claim 1, further comprising:

a means for filtering said dust entrained by said vacuum means; and means for connecting said flexible tubular conduit to said means for filtering, and diverting said dust entrained by said vacuum means away from said motor means.

9. An apparatus according to claim 1, further comprising:

a collar, adapted to rotatably carry said brush shaft, disposed in said intake opening of said flexible tubular conduit, substantially occluding said intake opening and having at least one port for allowing air flow from said vent into said flexible tubular conduit.

10. A method of removing dust from a vent of the type forming an angle with a vent opening and having a vent diameter, comprising in combination the steps of:

providing an external brush coupled to a flexible shaft, the flexible shaft being, in turn, disposed within a flexible vacuum conduit having a diameter substantially less than said vent diameter for allowing said flexible conduit to be passed through said angle in said vent;

inserting said external brush into said vent opening, thereby substantially occluding said vent;

passing said flexible conduit inward along said vent through said angle;

rotating said flexible shaft to cause said brush to rotate in said vent and dislodge said dust;

applying a vacuum source to said flexible vacuum conduit to draw an air stream containing said dust from said vent into said conduit; and removing said brush from said vent.

11. A method according to claim 10 wherein the steps of rotating said flexible rotatable shaft, applying said vacuum source, and removing said brush are performed simultaneously.

12. A method according to claim 10 further comprising:

filtering said air stream produced by applying said vacuum source to said vacuum conduit to remove said dust.

13. An apparatus for removing dust from a vent of the type forming an angle with a vent opening and having a vent diameter, comprising:

a flexible tubular conduit having a conduit diameter substantially less than said vent diameter for allowing said tubular conduit to be passed through said angle in said vent and an intake opening at one end and an exhaust opening at the opposite end;

a flexible shaft located within said flexible tubular conduit and extending substantially between said intake opening and said exhaust opening;

a brush coupled to said flexible shaft at approximately said intake opening of said flexible tubular conduit, said brush having a plurality of flexible bristles located externally of said flexible tubular conduit, and having a brush diameter substantially greater than said conduit diameter of said flexible tubular conduit, wherein said brush is adapted in diameter to substantially occlude said vent substantially obstructing the flow of air therethrough;

a single mobile housing;

motor means, disposed in said single mobile housing, coupled to said flexible shaft at approximately said exhaust opening of said flexible tubular conduit, for rotating said flexible shaft causing said brush to dislodge said dust from said vent; and vacuum means disposed in said single mobile housing for entraining said dust dislodged by said brush and drawing said dust from said intake opening of said flexible tubular conduit to said exhaust opening of said flexible tubular conduit.

* * * * *